US011085632B2

(12) United States Patent
Doerr et al.

(10) Patent No.: US 11,085,632 B2
(45) Date of Patent: Aug. 10, 2021

(54) NOZZLE FOR A COMBUSTION CHAMBER OF AN ENGINE

(71) Applicant: Rolls-Royce Deutschland Ltd & Co KG, Blankenfelde-Mahlow (DE)

(72) Inventors: Thomas Doerr, Berlin (DE); Sebastian Bake, Berlin (DE); Thilo Dauch, Karlsruhe (DE); Rainer Koch, Bruchsal (DE); Hans-Joerg Bauer, Pforzheim (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 171 days.

(21) Appl. No.: 16/161,871

(22) Filed: Oct. 16, 2018

(65) Prior Publication Data

US 2019/0113226 A1 Apr. 18, 2019

(30) Foreign Application Priority Data

Oct. 17, 2017 (DE) ..... 10 2017 218 529.5

(51) Int. Cl.
*F23R 3/28* (2006.01)
*F23D 11/38* (2006.01)
*F23R 3/14* (2006.01)

(52) U.S. Cl.
CPC ..... *F23D 11/383* (2013.01); *F23R 3/14* (2013.01); *F23R 3/286* (2013.01); *F23D 2206/10* (2013.01); *F23D 2900/11101* (2013.01)

(58) Field of Classification Search
CPC .. F23R 3/286; F23R 3/14; F23R 3/343; F23C 7/004; F23D 11/104; F23D 11/105; F23D 2900/11101
See application file for complete search history.

(56) References Cited

U.S. PATENT DOCUMENTS 3,980,233 A * 9/1976 Simmons ..... F23D 11/107 239/400
4,941,617 A 7/1990 Russell
(Continued)

FOREIGN PATENT DOCUMENTS

DE 2544361 A1 4/1976
DE 102009017056 A1 10/2009
GB 1491383 A 11/1977

OTHER PUBLICATIONS

European Search Report dated Feb. 25, 2019 for counterpart European Patent Application No. 18198872.6.
(Continued)

*Primary Examiner* — Gerald L Sung
*Assistant Examiner* — Rene D Ford
(74) *Attorney, Agent, or Firm* — Shuttleworth & Ingersoll, PLC; Timothy Klima

(57) ABSTRACT

A nozzle for a combustion chamber of an engine for providing a fuel-air mixture at a nozzle exit opening of the nozzle includes a nozzle main body including the nozzle exit opening and extends along a nozzle longitudinal axis. The nozzle main body has a first air guiding channel, a fuel guiding channel and a further, radially outwardly second air guiding channel. One end of the fuel guiding channel is positioned in front of the end of the second air guiding channel. A tapering channel portion with a shell surface inclined with respect to a nozzle longitudinal axis in the axial direction and connects to a radially outer shell surface of the fuel guiding channel is formed between the end of the fuel guiding channel and the end of the second air guiding channel at the nozzle.

16 Claims, 6 Drawing Sheets

(56) References Cited

U.S. PATENT DOCUMENTS

| | | | | |
|---|---|---|---|---|
| 4,946,105 | A * | 8/1990 | Pane, Jr. | B05B 7/065 239/398 |
| 5,044,559 | A * | 9/1991 | Russell | F23D 11/107 239/406 |
| 9,423,137 | B2 | 8/2016 | Nickolaus | |
| 9,927,126 | B2 | 3/2018 | Benjamin et al. | |
| 10,295,186 | B2 * | 5/2019 | Zink | F23R 3/14 |
| 2007/0028619 | A1 | 2/2007 | Spooner | |
| 2009/0100837 | A1 * | 4/2009 | Von Der Bank | F23R 3/14 60/737 |
| 2009/0255258 | A1 | 10/2009 | Bretz et al. | |
| 2010/0308135 | A1 | 12/2010 | Yamamoto et al. | |
| 2014/0174096 | A1 * | 6/2014 | Milosavljevic | F02C 3/30 60/776 |
| 2014/0241871 | A1 * | 8/2014 | Gregory | F23R 3/12 415/208.1 |
| 2014/0338353 | A1 | 11/2014 | Milosavljevic | |
| 2016/0084503 | A1 | 3/2016 | Hawie et al. | |
| 2016/0097536 | A1 * | 4/2016 | Wang | F23D 11/107 60/776 |
| 2016/0097537 | A1 * | 4/2016 | Wang | F23R 3/04 60/776 |
| 2017/0082288 | A1 | 3/2017 | Ryon et al. | |
| 2017/0268782 | A1 | 9/2017 | Huang et al. | |

OTHER PUBLICATIONS

German Search Report dated Jun. 13, 2018 for counterpart German Patent Application No. 10 2017 218 529.5.

* cited by examiner

NOZZLE FOR A COMBUSTION CHAMBER OF AN ENGINE

This application claims priority to German Patent Application DE102017218529.5 filed Oct. 17, 2017, the entirety of which is incorporated by reference herein.

The invention relates to a nozzle for a combustion chamber of an engine for providing a fuel-air mixture at a nozzle exit opening of the nozzle.

An (injection) nozzle for a combustion chamber of an engine, in particular for an annular chamber of a gas turbine engine, has a nozzle main body that comprises the nozzle exit opening and that, in addition to a fuel guiding channel for conveying fuel to the nozzle exit opening, has multiple (at least two) air guiding channels for conveying air that is to be intermixed with fuel to the nozzle exit opening. A nozzle usually also serves for swirling the supplied air, which, intermixed which the supplied fuel, is subsequently conveyed into the combustion chamber at the nozzle exit opening of the nozzle. For example, multiple nozzles may be grouped together in a nozzle assembly group that comprises multiple nozzles arranged next to each other, usually along a circular line, for introducing fuel into the combustion chamber.

In nozzles with multiple air guiding channels and at least one fuel guiding channel as they are known from the state of the art, for example from U.S. Pat. No. 9,423,137 B2, it is provided that a first air guiding channel extends along a nozzle longitudinal axis of the nozzle main body and a fuel guiding channel is positioned radially further outwards than the first air guiding channel with respect to the nozzle longitudinal axis. In that case, at least one further, second air guiding channel is positioned radially further outwards than the fuel guiding channel with respect to the nozzle longitudinal axis. Here, one end of the fuel guiding channel at which the fuel from the fuel guiding channel flows out in the direction of the air from the first air guiding channel is typically located with respect to the nozzle longitudinal axis and in the direction of the nozzle exit opening in front of the end of the second air guiding channel from which the air then flows out in the direction of a mixture of air from the first air guiding channel and fuel from the fuel guiding channel. What is further known from the state of the art and for example also provided in U.S. Pat. No. 9,423,137 B2 is to provide such a nozzle with a third air guiding channel, with its end, which may also be displaced radially outwards, following the end of the second air guiding channel in the axial direction.

For the process of the combustion in a combustion space of the combustion chamber of the engine, the nozzle design is of crucial importance as it determined with what (local) distribution the fuel in the fuel-air mixture is transported into the combustion space. In principle, it is advantageous in this context that the fuel is distributed homogenously in the resulting fuel-air mixture in the form of droplets.

Against this background, there is the objective to provide a nozzle that is improved in this regard.

What is proposed in this context is a nozzle that has at least one first and a second air guiding channel as well as a fuel guiding channel, and in which, between the end of the fuel guiding channel and the end of the second air guiding channel at the nozzle, a tapering or converging channel portion with a shell surface that is inclined (in the cross section) in the axial direction with respect to the nozzle longitudinal axis of the nozzle main body is formed, wherein this shell surface connects to a radially outer shell surface of the fuel guiding channel.

Thus, it has been shown that an inclined shell surface of a connecting channel portion defines a guide surface at which a pre-film of fuel can attach. Through the geometry of the tapering channel portion, uneven fuel flows can be avoided. Further, a film of fuel can attach at the shell surface of the tapering channel portion, which is at most subject to small oscillation amplitudes at a trailing edge of the fuel guiding channel, which leads to an equalizing of the supplied fuel amount and thus ultimately to a more homogenous droplet distribution of the fuel in the fuel-air mixture that is provided at the nozzle exit opening of the nozzle. The tapering contour of the channel portion in the direction of the end of the second air guiding channel and thus in the direction of the nozzle exit opening thus has the surprising advantage that in this way non-stationary accumulations of fuel and non-stationary fuel outlet flows at the end of the fuel guiding channel can be avoided. Thus, a nozzle that is shape-optimized in the proposed manner can provide a spray of fuel and air with a small drop diameter that is continuous over time, which in turn leads to a reduction of the pollutants that are created during combustion in the combustion space.

The proposed nozzle may for example be an air-assisted injection nozzle.

Of course, with the proposed nozzle, it is also possible to provide a nozzle assembly group for a combustion chamber of an engine in which multiple similar or even identically designed nozzles are arranged next to each other, for example next to each other along a circular line. Such a nozzle assembly group can for example be used in an annular combustion chamber of a gas turbine engine.

In an exemplary embodiment, the channel portion at the end of the nozzle main body is formed in the manner of a truncated cone. Here, the shape of a truncated cone of the channel portion has proven to be advantageous in certain nozzle geometries.

With a view to achieving a homogenous fuel drop distribution, it is provided in an exemplary embodiment that the channel portion tapers in the direction of the nozzle exit opening by at least 0.1 mm. Alternatively or additionally, the taper in the direction of the nozzle exit opening can be limited to maximally 4 mm. Although these dimensions and in particular this degree of taper of the channel portion seem relatively small, it has been shown that the fuel-air mixture provided at the nozzle exit opening of the nozzle can be significantly influenced in this way.

In an exemplary embodiment, the shell surface of the channel portion extends so as to be inclined at an angle to the nozzle longitudinal axis that is smaller than 40°. For example, this angle may be in a range of 1° to 40°, in particular in a range of 2° to 38° or 3° to 35° or 2° to 20°. In an exemplary embodiment, the (inclination) angle of the shell surface of the tapering channel portion may e.g. be in the range of 3° to 18°, in particular in the range of 5° to 15°.

In one embodiment variant, the channel portion extends with a length of at least 1 mm along the nozzle longitudinal axis. A length of the channel portion of at least 1 mm along the nozzle longitudinal axis for example also results in the shell surface of the channel portion having an axial length of at least 1 mm. Here, the length of the channel portion is usually chosen in such a manner that a spatial decoupling of local vibrations resulting from an unsteady discharge of the fuel and of the two-phase mixture of fuel and air at a radially outer trailing edge of the fuel guiding channel can be realized. Here, the length of the channel portion can vary depending on the respective engine type, and can thus in particular depend on the amount of fuel to be supplied or a fuel-air mixture to be supplied. A maximum length of the channel portion along the nozzle longitudinal axis of below 7 mm is considered to be advantageous in some embodiment variants.

In one embodiment variant, the shell surface of the channel portion is offset radially outwards in the area of the end of the fuel guiding channel by a distance in the range of at least 0.2 mm to an end of a shell surface of the first air guiding channel. Thus, through the channel portion, locally a widening is present as compared to the first air guiding channel in the area of the end of the fuel guiding channel. Thus, for example at the end of the fuel guiding channel a channel diameter that is provided from the flowing-out fuel and the air from the first air guiding channel is enlarged by at least 2×0.2 mm=0.4 mm. An outflow opening of the fuel guiding channel thus does not extend in parallel to the nozzle longitudinal axis, as for example in U.S. Pat. No. 9,423,137 B2, but the fuel guiding channel transitions an its end into the axially extending and (conically) tapering channel portion.

Alternatively or additionally, it is provided in one embodiment variant that the shell surface of the channel portion in the area of the end of the second air guiding channel is offset radially outwards with respect to an end of a shell surface of the first air guiding channel (although of course such an offset is not absolutely necessary). Thus, in this variant, a larger or smaller diameter can be provided at a with respect to the nozzle exit opening rear end of the channel portion than at the end of the first air guiding channel. Thus, in the initially mentioned variant, one end of the channel portion does not protrude radially inward beyond a virtual extension of a radially outer terminal edge of the first air guiding channel, while in the last-mentioned variant the end of the channel portion projects straight radially inward beyond such a virtual extension. In this way, it is determined in combination with the previously explained variant of a radial attachment at the beginning of the tapering channel portion (in the area of the end of the fuel guiding channel) that for example a diameter of the channel portion is always larger than a diameter of an upstream first air guiding channel of the nozzle at the end of the fuel guiding channel, or can also be smaller at least at the end of the channel portion.

In a possible further development, the shell surface of the channel portion is offset radially outwards in the area of the end of the second air guiding channel by a distance of maximally 1 mm with respect to an end of a shell surface of the first air guiding channel. Alternatively or additionally, in the area of the end of the second air guiding channel, the shell surface of the channel portion is offset radially inwards by a distance of maximally 0.1 to an end of a shell surface of the first air guiding channel (26).

In particular based on the above-described channel geometries at the tapering channel portion, it can be provided in one embodiment variant that the channel portion, at its widest position in the area of the end of the fuel guiding channel, has a diameter that is larger by 0.4 mm than the first air guiding channel at the end of the fuel guiding channel, that is, in that position in which the fuel guiding channel opens into the first air guiding channel. However, at its widest position, the diameter of the channel portion can of course also be larger by a smaller measure than the diameter of the first air guiding channel at the end of the fuel guiding channel. In one variant, it would even be conceivable that, at its widest position, the diameter of the channel portion corresponds to the diameter of the first air guiding channel at the end of the fuel guiding channel.

Alternatively or additionally, it can be provided that, at its narrowest position in the area of the end of the second air guiding channel, the channel portion has a diameter that is larger by maximally 2 mm, in particular maximally 1.4 mm, and/or that is smaller by maximally 0.2 mm than the first air guiding channel at the end of the fuel guiding channel. As has already been explained, in the first-mentioned variant, the channel portion has an even larger diameter than the first air guiding channel at the end of the fuel guiding channel, here a diameter that is larger by at least 0.2 mm, also at its rear end with respect to the flow direction of the air, of the fuel or of the fuel-air mixture. For example, it can be provided that, at its narrowest position in the area of the end of the second air guiding channel, the channel portion has a diameter that is larger by at least 0.2 mm than the first air guiding channel at the end of the fuel guiding channel. In the other mentioned variant, the channel portion tapers or converges so strongly over its length that, in the area of the end of the second air guiding channel and thus at the end side at its narrowest position, the channel portion has a diameter that is equal to or smaller than the diameter of the first air guiding channel at the end of the fuel guiding channel.

With a view to avoiding non-stationary accumulations of fuel and fuel outlet flows at the end of the fuel guiding channel, it can be advantageous to predefine a particular relationship between the geometry of the parameters that define the channel portion. In one embodiment variant, it is for example provided that the shell surface of the channel portion in the area of the fuel guiding channel is offset radially outwards by a distance $\Delta r_1$ with respect to an end of a shell surface of the first air guiding channel, and the channel portion extends with a length $x_{PF}$ along the nozzle longitudinal axis of the nozzle main body, so that the following applies:

$$x_{PF} \geq 2\ \Delta r_1.$$

In a further development, it may further apply that $x_{PF} \geq 3\ \Delta r_1$.

As has already been explained above, it can further in particular apply to $x_{PF} \geq 2\ \Delta r_1$ or $x_{PF} \geq 3\ \Delta r_1$ that the length $x_{PF}$ is for example larger or equal to 2 mm and the radial distance $\Delta r_1 <$ is 1 mm, in particular ≤0.8 mm and e.g. ≤0.665 mm.

In an exemplary embodiment, the radially outer shell surface of the fuel guiding channel transitions into the inclined shell surface of the channel portion via a curvature. An even and edge-free transition between the radially outer shell surface of the fuel guiding channel and the shell surface of the connecting channel portion can further support a fuel feed or fuel injection that is even spatially as well as over time. For example, the (convex) curvature at the transition between the radially outer shell surface of the fuel guiding channel and the inclined shell surface of the channel portion has a radius of maximally 8 mm. In one embodiment variant, the curvature has a radius of maximally 2 mm.

In one embodiment variant, it is possible to provide a concave curvature at a radially inner shell surface of the fuel guiding channel via which an obliquely radially inward oriented section of the radially inner shell surface transitions into an axially extending section of the radially inner shell surface. In particular in such an embodiment variant, in which an end of the radially inwardly located edge of the fuel guiding channel also extends axially, an opposite convex curvature can be formed at the radially outer shell surface. As stated above, in that case this opposite curvature of the radially outer shell surface can e.g. have a radius of maximally 8 mm, and thus facilitates a smoother transition of the fuel guiding channel towards the tapering channel portion. A concave curvature at the radially inner shell surface of the fuel guiding channel may for example have a radius of maximally 15 mm, in particular of maximally 10 mm, 8 mm, 5 mm or 2 mm, for example.

For avoiding local back flows, it is provided in one exemplary embodiment that a sharp-edged transition is formed between a shell surface of the first air guiding channel and an inner shell surface of the fuel guiding channel at the end of the fuel guiding channel. Thus, for example a wall section of the nozzle main body, which, on the one hand, forms the inner (radial inwardly located) shell surface of the fuel guiding channel and, on the other hand, the (radially outer) shell surface of the first air guiding channel, is formed so as to taper off to an edge at the end of the fuel guiding channel and of the first air guiding channel.

Alternatively or additionally, a sharp-edged transition between the shell surface of the channel portion and an inner shell surface of the second air channel can be formed for avoiding local back flows at the end of the tapering channel portion. Analogously, here a wall section of the nozzle main body which, on the one hand, forms the shell surface of the channel portion and, on the other hand, forms the radially inner shell surface of the second air guiding channel can be formed in such a manner that is tapers off in the direction of the nozzle exit opening. This results in a sharp edge at the end of the channel portion at the transition to an outflow opening of the second air guiding channel.

Further, the proposed solution also comprises a nozzle assembly group with multiple identically designed nozzles, respectively forming a tapering channel portion between the end of a fuel guiding channel and the end of a second air guiding channel at a nozzle in the area of the nozzle exit opening of the respective nozzle. What is further comprised is an engine with at least one such nozzle or such a nozzle group.

The attached Figures illustrate possible embodiment variants of the suggested solution by way of example.

Herein:

Figure 2A:
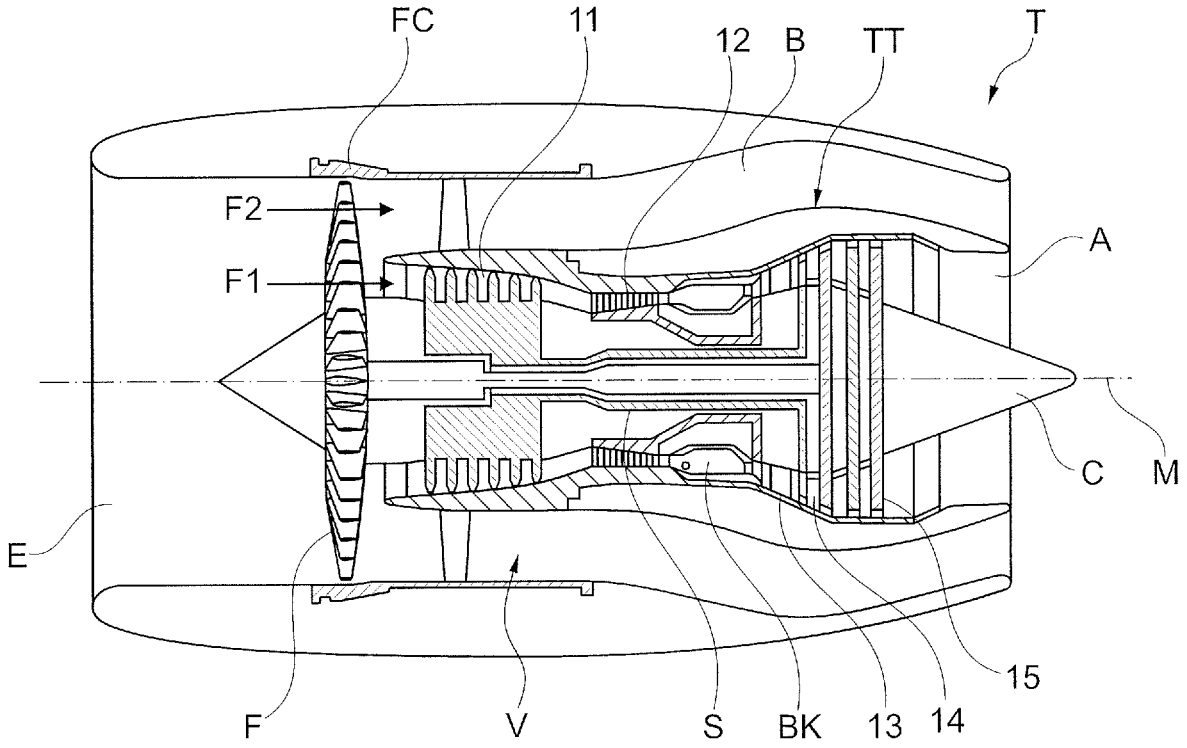
FIG. 2A shows an engine in which a combustion chamber with a nozzle according to FIG. 1 is used.

FIG. 2A schematically illustrates, in a sectional view, a (turbofan) engine T in which the individual engine components are arranged in succession along a rotational axis or central axis M and the engine T is embodied as a turbofan engine. By means of a fan F, air is suctioned in along an entry direction at an inlet or an intake E of the engine T. This fan F, which is arranged inside a fan housing FC, is driven via a rotor shaft S that is set into rotation by a turbine TT of the engine T. Here, the turbine TT connects to a compressor V, which for example has a low-pressure compressor 11 and a high-pressure compressor 12, and where necessary also a medium-pressure compressor. The fan F supplies air to the compressor V in a primary air flow F1, on the one hand, and, on the other, to a secondary flow channel or bypass channel B in a secondary air flow F2 for creating a thrust. Here, the bypass channel B extends about a core engine that comprises the compressor V and the turbine TT, and also comprises a primary flow channel for the air that is supplied to the core engine by the fan F.

The air that is conveyed via the compressor V into the primary flow channel is transported into the combustion chamber section BK of the core engine where the driving power for driving the turbine TT is generated. For this purpose, the turbine TT has a high-pressure turbine 13, a medium-pressure turbine 14, and a low-pressure turbine 15. The turbine TT drives the rotor shaft S and thus the fan F by means of the energy that is released during combustion in order to generate the necessary thrust by means of the air that is conveyed into the bypass channel B. The air from the bypass channel B as well as the exhaust gases from the primary flow channel of the core engine are discharged via an outlet A at the end of the engine T. Here, the outlet A usually has a thrust nozzle with a centrally arranged outlet cone C.

Figure 2B:
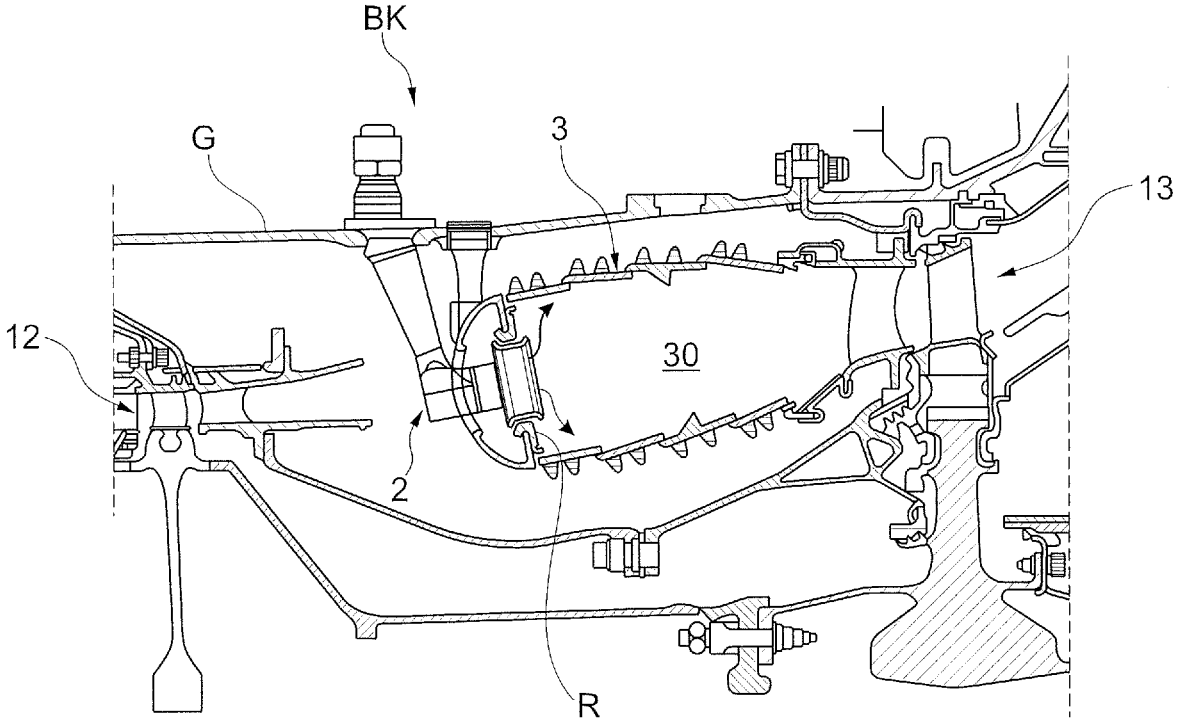
FIG. 2B shows, in sections and on an enlarged scale, the combustion chamber of the engine of FIG. 2A.

FIG. 2B shows a longitudinal section through the combustion chamber section BK of the engine T. Here, in particular an (annular) combustion chamber 3 of the engine T can be seen. A nozzle assembly group is provided for injecting fuel or an air-fuel mixture into a combustion space 30 of the combustion chamber 3. It comprises a combustion chamber ring R at which multiple (fuel/injection) nozzles 2 are arranged along a circular line about the central axis M. Here, the nozzle exit openings of the respective nozzles 2 that are positioned inside the combustion chamber 3 are provided at the combustion chamber ring R. Here, each nozzle 2 comprises a flange by means of which a nozzle 2 is screwed to an outer housing G of the combustion chamber 3.

Figure 2C:
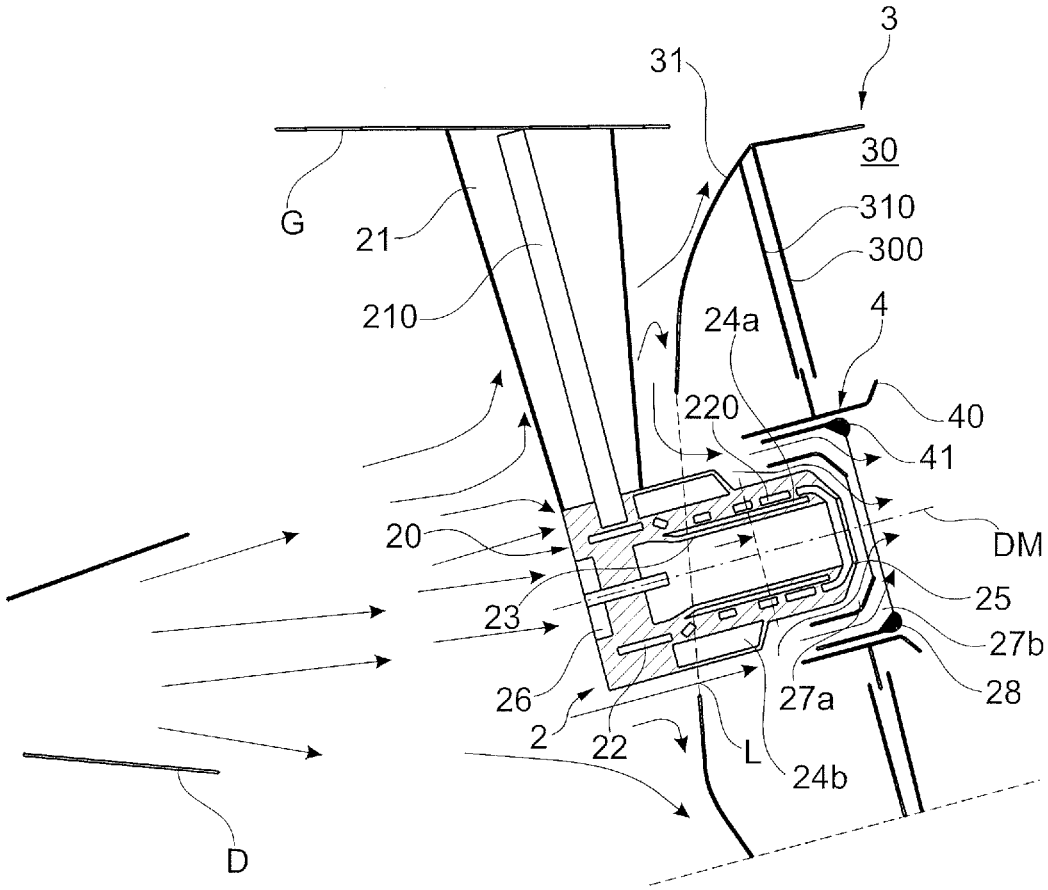
FIG. 2C shows, in a cross-sectional view, the general structure of the nozzle of FIG. 1 and the surrounding components of the engine in the installed state of the nozzle.

FIG. 2C now shows a cross-sectional view of the basic structure of a nozzle 2 as well as the surrounding components of the engine T in the installed state of the nozzle 2. Here, the nozzle 2 is part of a combustion chamber system of the engine T. The nozzle 2 is located downstream of a diffuser D, and during mounting is inserted through an access hole L through a combustion chamber head 31, through a heat shield 300 and a head plate 310 of the combustion chamber 3 up to the combustion space 30 of the combustion chamber 3, so that a nozzle exit opening formed at a nozzle main body 20 reaches all the way to the combustion space 30. The nozzle 2 further comprises a nozzle neck 21 which substantially extends radially with respect to the central axis M and inside of which a fuel supply 210 conveying fuel to the nozzle main body 20 is accommodated. Further formed at the nozzle main body 20 are a fuel chamber 22, fuel passages 220, heat shields 23 as well as air chambers for insulation.

In addition, the nozzle main body 20 forms a (first) inner air guiding channel 26 extending centrally along a nozzle longitudinal axis DM and, positioned radially further outside with respect to the same, (second and third) outer air guiding channels 27*a* and 27*b*. These air guiding channels 26, 27*a* and 27*b* extend in the direction of the nozzle exit opening of the nozzle 2.

Further, also at least one fuel guiding channel 25 is formed at the nozzle main body 20. This fuel guiding channel 25 is located between the first inner air guiding channel 26 and the second outer air guiding channel 27*a*.

The end of the fuel guiding channel 25, via which fuel flows out in the direction of the air from the first inner air guiding channel 26 during operation of the nozzle 2, is located with respect to the nozzle longitudinal axis DM and in the direction of the nozzle exit opening in front of the end of the second air guiding channel 27*a* from which air from the second, outer air guiding channel 27*a* flows out in the direction of a mixture of air from the first, inner air guiding channel 26 and fuel from the fuel guiding channel 25.

Usually, also swirling elements for swirling the air that is supplied via these are provided in the outer air guiding channels 27*a* and 27*b* (cf. FIG. 1). Further, the nozzle main body 20 also comprises an outer, radially inwardly oriented air guiding element 41 at the end of the third outer air guiding channel 27*b*. A sealing element 28 is also provided at the nozzle main body 20 at its circumference for sealing the nozzle 2 towards the combustion space 30. This sealing element 28 forms a counter-piece to a so-called burner seal 4. This burner seal 4 is floatingly mounted between the heat shield 300 and the head plate 310 to compensate for radial and axial movements between the nozzle 2 and the combustion chamber 3 and to ensure reliable sealing in different operational states.

The burner seal 4 usually has a flow guiding element 40 towards the combustion space 30. In connection with the third outer air guiding channel 41 at the nozzle 2, this flow guiding element 40 ensures a desired flow guidance of the fuel-air mixture that comes from the nozzle 2, more precisely the swirled air from the air guiding channels 26, 27*a* and 27*b*, as well as the fuel guiding channel 25.

In the nozzle 2 of FIG. 2C, which is a pressure-assisted injection nozzle, the ends of the second and third radially outwardly located air guiding channels 27*a* and 27*b* follow—with respect to the nozzle longitudinal axis DM and in the direction of the nozzle exit opening—the end of the fuel guiding channel 25 from which fuel is supplied to the air from the first inner centrally extending air guiding channel 26 during operation of the engine T. In order to avoid non-stationary accumulations of fuel and fuel outlet flows at this end of the fuel guiding channel 25 during operation of the engine T and to achieve an equalizing of the fuel feed or the fuel injection over time as well as space, a design of the nozzle end (of the end of the nozzle main body 20) is proposed which is geometrically improved in this regard. An embodiment variant of it is illustrated on an enlarged scale in FIG. 1.

Figure 1A:
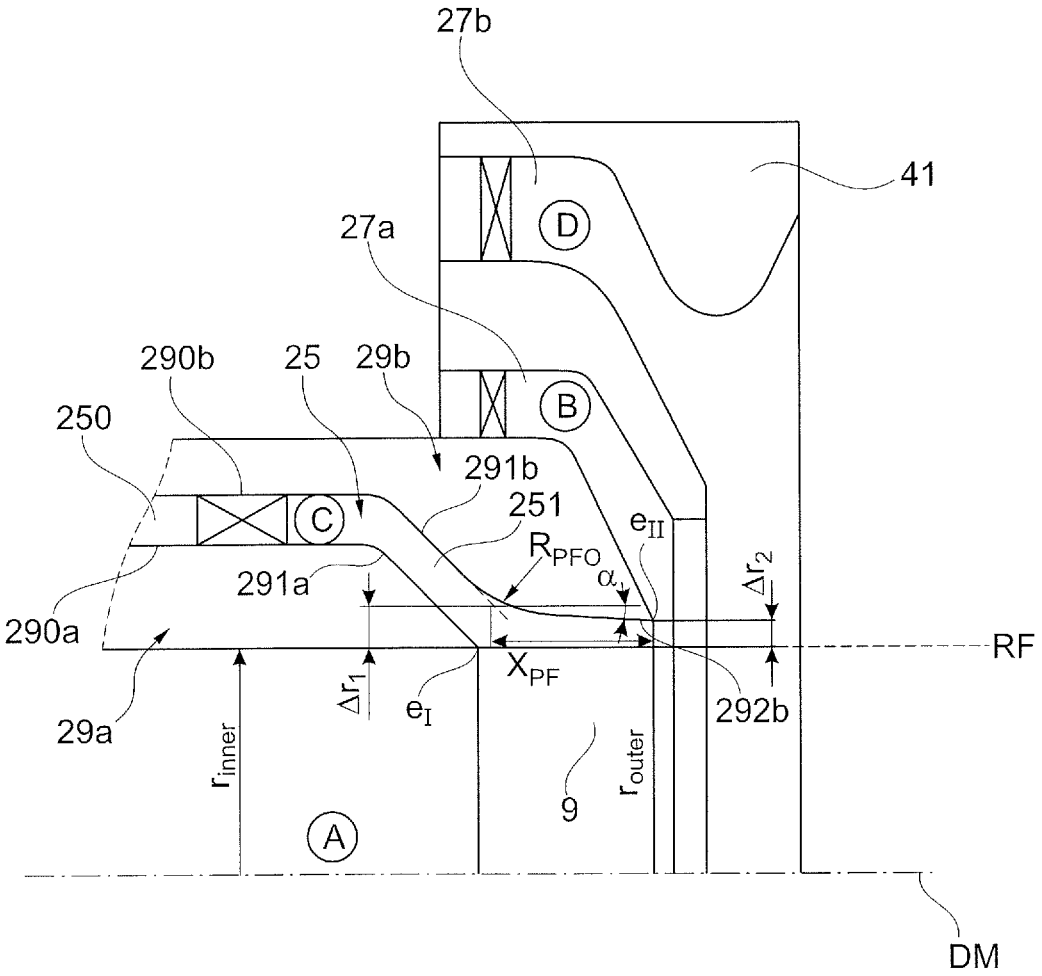
FIG. 1A shows, on an enlarged scale and in sections, the area at a nozzle exit opening of a nozzle with a conically tapering channel portion between the end of a fuel guiding channel and an end of a second air guiding channel of the nozzle for avoiding non-stationary accumulations of fuel and fuel outlet flows at the end of the fuel guiding channel.

In the nozzle 2 shown in FIG. 1A, a tapering channel portion 9 with a shell surface 292*b* that extends in an inclined manner in the axial direction is formed between the end of the fuel guiding channel 25 and the end of the second air guiding channel 27*a* at the nozzle 2. Here, the inclined shell surface 292*b* of the channel portion 9 connects to a radially outer shell surface 291*b* of the fuel guiding channel 25. Here, the shell surfaces 291*b* and 292*b* extend at an angle to each other that is larger than 10° so as to define, via the shell surface 292*b* connecting to the fuel guiding channel 25, a "pre-film" surface for attachment of fuel, extending in the direction of the nozzle exit opening. The fuel guiding channel 25 thus transitions into the channel portion 9 which tapers off in the direction of the nozzle exit opening and thus towards an end of the second radially outwardly located air guiding channel 27*a* or that converges in the direction of the nozzle exit opening.

Here, at the end of the nozzle 2, the fuel guiding channel 25 is formed with a radially inwardly angled channel section 251. This angled channel section 251 connects to a channel section 250 of the fuel guiding channel 25 that extends substantially in parallel to the nozzle longitudinal axis DM and that is bordered, corresponding to the cross-sectional view of FIG. 1A, by inner and outer shell surfaces 290*a* and 290*b* that extend in parallel to one another. While thus a radially inwardly located shell surface 291*a* of the connecting angled channel section 251 is guided up to a shell surface of the first air guiding channel 26, the opposite, radially outer shell surface 291*b* of the angled channel section 251 transitions into the shell surface 292*b* of the channel portion 9, which has a larger diameter as compared to the first, inner air guiding channel 26. In the present case, the transition between the fuel guiding channel 25 and the channel portion 9 in the area of the shell surfaces 291*b* and 292*b* is designed to be continuous and edge-free via a curvature that has a radius $R_{PFO}$, here of maximally 2 mm.

The (consistently) larger diameter of the channel portion 9 as compared to the diameter of the inner, first air guiding channel 26 results from a radial offset of the outer shell surface 292*b* of the channel portion 9 to an end of the shell surface of the first air guiding channel 26. Thus, the fuel guiding channel 25 is not completely guided up to a diameter of the first air guiding channel 26. Rather, at its widest position in the area of the end of the fuel guiding channel 25, the diameter of the channel portion 9 is larger than a diameter $2r_{inner}$ of the first air guiding channel 26 at the end of the fuel guiding channel 25 by a distance $2\Delta r_1$. Thus, in the area of the end of the fuel guiding channel 25, the shell surface 292*b* of the channel portion 9 is offset radially outwards by a distance $\Delta r_1$ to an end of the shell surface of the first air guiding channel 26. In the shown embodiment variant, the distance $\Delta r_1$ is less than 0.8 mm, in particular less than 0.665 mm. For example, the distance $\Delta r_1$ can be at least 0.2 mm and maximally 2 mm. However, in principle, $\Delta r_1$ can also be less than 0.2 mm, or even zero.

The channel portion 9 tapers in the direction of the nozzle exit opening over a length $x_{PF}$. However, an offset to the end of the first air guiding channel 26 still remains. The shell surface 292*b* of the channel portion 9 is also radially offset in the area of the end of the second air guiding channel 27*b* and thus at the (rear, downstream) end of the channel portion 9 by a distance $\Delta r_2$ (with $0 \leq \Delta r_2 < \Delta r_1$) to the shell surface of the first air guiding channel 26. Accordingly, while extending radially inward, the shell surface 292*b* of the channel portion 9 does not extend beyond a virtual extension of a radially outer terminal edge of the first air guiding channel 26. Here, the virtual extension of the radially outer terminal edge of the first air guiding channel 26 is shown in FIG. 1A over a reference axis RF. The diameter of the channel portion 9 is thus always larger than the diameter of the first air guiding channel 26 at the end of the fuel guiding channel 25. In the shown embodiment variant of FIG. 1A, a distance $\Delta r_2$ is for example at least 0.1 mm, in particular 0.2 mm.

The taper of the channel portion 9 is further chosen in such a manner that the shell surface 292*b* of the channel portion 29 extends at an angle $\alpha \leq 40°$ to the nozzle longitudinal axis DM. Through such a taper over a length of $x_{PF}$ of at least 1 mm, in particular of at least 2 mm, an even flow of fuel to the nozzle exit opening can be achieved during operation. Further, a spatial decoupling of local vibrations can be avoided due to an uneven flow-out of fuel and of a two-phase mixture of fuel and air at a radially outer trailing edge of the fuel guiding channel 25. Non-stationary accumulations of fuel and fuel outlet flows at the end of the fuel guiding channel 25 are also avoided. The fuel is then conveyed more evenly via the shell surface 292*b* of the channel portion 9 which then serves as a guide surface for a film of fuel, which results in a homogenous fuel drop distribution in the fuel-air mixture at the nozzle exit opening. A thus resulting spray with a small fuel drop diameter that is continuous over time in turn leads to the reduction of pollutants created during combustion in the combustion space 30. The length $x_{PF}$ can be limited to maximally 7 mm, for example. For example, $x_{PF} \geq 3\ \Delta r_1$ applies.

In contrast to the variant shown in FIG. 1, the distances $\Delta r_1$ and $\Delta r_2$ and the length $x_{PF}$ can also be chosen in a different manner, in particular depending on a predefined mass flow of fuel at certain predefined operating points of the engine T as well as the diameter $2r_{inner}$ of the inner first air guiding channel 26. The length in $x_{PF}$ should for example be so long that local non-stationary effects due to the discharge of fuel from the fuel guiding channel 25 are spatially separated from a multiphase flow at a (atomizer) edge $e_{ll}$. This edge $e_{ll}$ is formed at a transition of the shell surface 292*b* of the channel portion 9 and a radially inner shell surface of the second outer air guiding channel 27*a*. The edge $e_{ll}$ is further designed to be as sharp as possible to avoid local back flows at the tapered end of the channel portion 9. A wall section 29*b* of the nozzle main body 2 which, on the one hand, forms the shell surface of the channel portion 9 and, on the other hand, forms the radially inner shell surface of the second air guiding channel 27*a*, thus tapers off towards the edge $e_{ll}$ at the end of the channel portion 9 and of the second air guiding channel 27*a*. Hereby, a sharp-edged transition is formed between the shell surface 292*b* of the channel portion 9 and the inner shell surface of the second air guiding channel 27*a*.

For avoiding back flows, a sharp-edged transition is also formed between the shell surface of the first air guiding channel 26 and the inner shell surface 291*a* of the fuel guiding channel 25 at the end of the fuel guiding channel 25. A wall section 29*a* of the nozzle main body 2 which, on the one hand, forms the inner shell surface 291*a* of the fuel guiding channel 25 and, on the other hand, forms the shell surface of the first air guiding channel 26 thus also tapers off towards an edge $e_l$ at the end of the fuel guiding channel 25 and of the first air guiding channel 26.

Incidentally, it is of course not absolutely necessary that the end of the shell surface 292*b* of the channel portion 9 and thus the (end) edge $e_{ll}$ is located radially outside with respect to the reference axis RF. In one embodiment variant, the (end) edge $e_{ll}$ can be located radially further inside with respect to the radially inner (end-) edge $e_l$ of the fuel guiding channel 25, so that a value for $\Delta r_2$ can be "negative", that is, $r_{inner} > r_{outer}$ applies, wherein 2 $r_{outer}$ corresponds to the diameter of the channel portion 9 at its nozzle-exit-side end (at the edge $e_{ll}$). For example, in such an embodiment variant, the geometry in the area of the channel portion 9 is characterized by $\Delta r_1$=0.2 mm, $\Delta r_2$=0.1 mm and $R_{PFO}$=1.0 mm, in a manner corresponding to the rendering of FIG. 1C that is enlarged in sections.

Figure 1B:
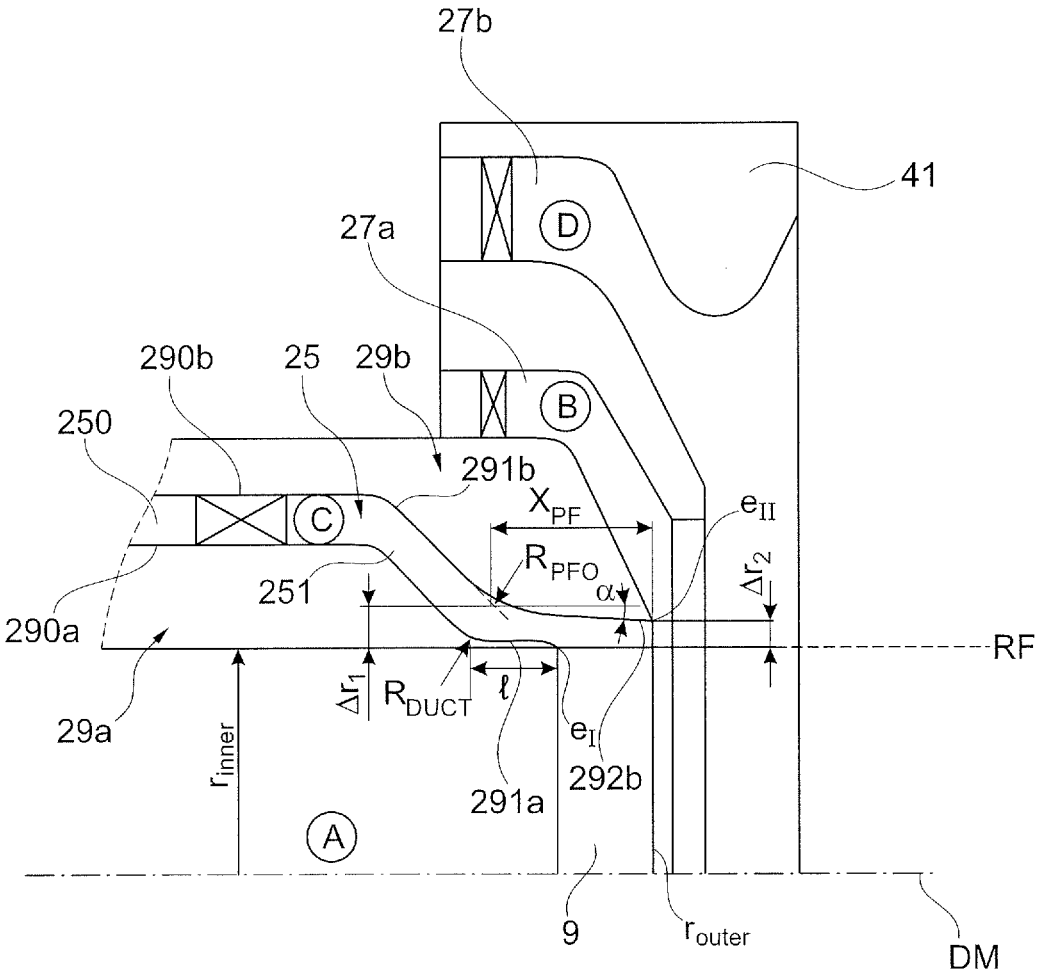
FIG. 1B shows a possible further development of the embodiment variant of FIG. 1A in a view corresponding to FIG. 1A.
Figure 1C:
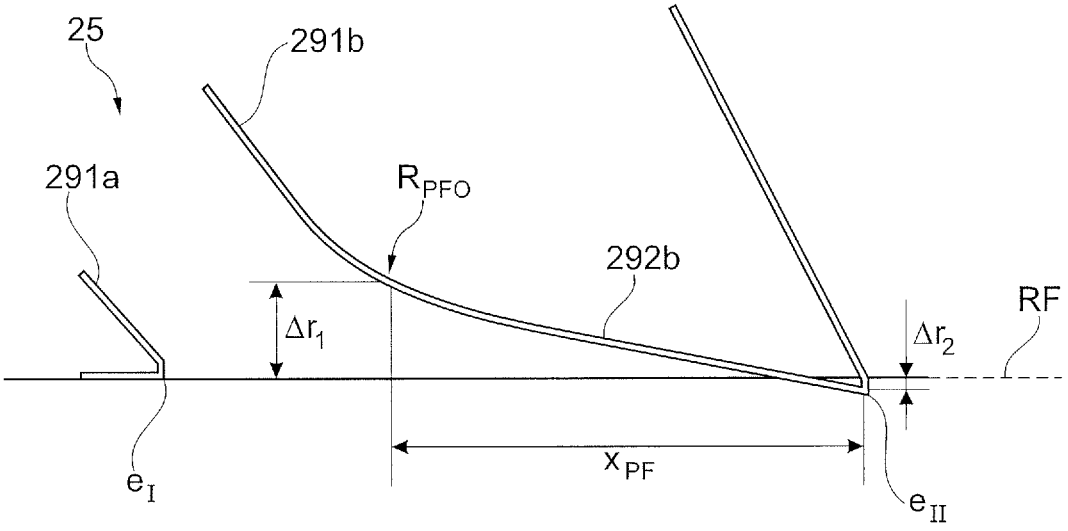
FIG. 1C shows, in sections, an enlarged rendering of a further development of the channel portion of FIG. 1A.

In the further development of the embodiment variant of FIG. 1A that is shown in FIG. 1B, an (end) section of the fuel guiding channel 25 also connects downstream to the angled channel section 251 of the fuel guiding channel 25 extending axially in the direction of the nozzle exit opening. Here, a concave curvature is provided at the radially inner shell surface 291*a* of the fuel guiding channel 25 via which the angled and thus obliquely radially inwardly oriented section of the radially inner shell surface transitions into an axially extending section. In the present case, the concave curvature has a radius $R_{Duct}$ of maximally 15 mm and is located opposite the convex curvature at the radially outer shell surface 291*b* with the radius $R_{PFO}$. An axial length of the axially extending, radial inwardly located end section of the fuel guiding channel 25 may for example only correspond to a fraction of the length $x_{PF}$. For example, this length is smaller than 0.5 $x_{PF}$.

The radius $R_{PFO}$ can vary depending on the size of the curvature at the radially inner shell surface 291*a* and in particular the accompanying axial length of the axially extending, radially inwardly located end section of the fuel guiding channel 25 (that is tapering towards the edge $e_l$ at the end). If an axially extending radially inwardly located end section of the fuel guiding channel 25 and a concave curvature with a radius $R_{Duct}$ provided for the transition are present, with $0 < R_{Duct} \leq 15$ mm, the radius $R_{PFO}$ of the convex curvature at the radially outer shell surface 291*b* is maximally 8 mm.

PARTS LIST

11 low-pressure compressor
12 high-pressure compressor
13 high-pressure turbine
14 medium-pressure turbine
15 low-pressure turbine
2 nozzle
20 nozzle main body
21 neck
210 fuel supply
22 fuel chamber
220 fuel passage
23 heat shield
24*a*, 24*b* air chamber
25 fuel guiding channel
250, 251 channel section
26 first air guiding channel
27*a* second air guiding channel
27*b* third air guiding channel
28 sealing element
290*a*, 290*b*, 291*a*, 291*b* shell surface
292*b* shell surface/guide surface
29*a*, 29*b* wall section
3 combustion chamber
30 combustion space
300 heat shield
31 combustion chamber head
310 head plate
4 burner seal
40 flow guiding element
41 air guiding element
9 channel portion
A outlet
B bypass channel
BK combustion chamber section
C outlet cone
D diffuser
DM nozzle longitudinal axis
E inlet/intake
$e_l$, $e_{ll}$ edge
F fan
F1, F2 fluid flow
FC fan housing
G outer housing
L access hole
M central axis/rotational axis
R combustion chamber ring
RF reference axis
$r_{inner}$ radius
$R_{Duct}$, $R_{PFO}$ radius
S rotor shaft T (turbofan) engine
TT turbine
V compressor
$x_{PF}$ length
$\Delta r_1$, $\Delta r_2$ distance
$\alpha$ angle

What is claimed is:

1. A nozzle for a combustion chamber of an engine for providing a fuel-air mixture at a nozzle exit opening of the nozzle, the nozzle comprising:

a nozzle main body that comprises the nozzle exit opening and that extends along a nozzle longitudinal axis, the nozzle main body further comprising:

a first air guiding channel for conveying air to the nozzle exit opening, the first air guiding channel also extending along the nozzle longitudinal axis, a fuel guiding channel for conveying fuel to the nozzle exit opening that is positioned radially further outwardly as compared to the first air guiding channel with respect to the nozzle longitudinal axis, and a second air guiding channel that is positioned radially further outwardly as compared to the fuel guiding channel with respect to the nozzle longitudinal axis, wherein an end of the fuel guiding channel at which fuel from the fuel guiding channel flows out in a direction of the air from the first air guiding channel, is positioned—with respect to the nozzle longitudinal axis and in a direction of the nozzle exit opening—in front of an end of the second air guiding channel from which air from the second air guiding channel flows out in a direction of a mixture of air from the first air guiding channel and fuel from the fuel guiding channel, a tapering channel portion with a first channel surface inclined with respect to the nozzle longitudinal axis in an axial direction and connecting to a radially outer second channel surface of the fuel guiding channel, the tapering channel portion positioned between the end of the fuel guiding channel and the end of the second air guiding channel, the tapering channel portion ending at the end of the second air guiding channel;

wherein the second channel surface transitions into the first channel surface via a curvature;

wherein the curvature has a radius of maximally 8 mm.

2. The nozzle according to claim 1, wherein the tapering channel portion is shaped as a truncated cone.

3. The nozzle according to claim 1, wherein the tapering channel portion tapers off in the direction of the nozzle exit opening by at least 0.1 mm and/or by maximally 4 mm.

4. The nozzle according to claim 1, wherein the first channel surface extends in an inclined manner at an angle to the nozzle longitudinal axis that is smaller than 40°.

5. The nozzle according to claim 1, wherein the tapering channel portion extends with a length of at least 1 mm and/or of maximally 7 mm along the nozzle longitudinal axis.

6. The nozzle according to claim 1, wherein, in an area of the end of the fuel guiding channel, the first channel surface is offset radially outwards by a distance of at least 0.2 mm to an end of a surface of the first air guiding channel.

7. The nozzle according to claim 1, wherein, in an area of the end of the second air guiding channel, the first channel surface is offset radially outwards to an end of a fourth channel surface of the first air guiding channel.

8. The nozzle according to claim 1, wherein, in the area of the end of the second air guiding channel, the first channel surface is offset radially outwards by a distance of maximally 1 mm or is offset radially inwards by a distance of maximally 0.1 mm to an end of a fourth channel surface of the first air guiding channel.

9. The nozzle according to claim 1, wherein, in an area of the end of the fuel guiding channel, the first channel surface is offset radially outwards by a distance ($\Delta r1$) to an end of a fourth channel surface of the first air guiding channel, and the tapering channel portion extends with a length (xPF) along the nozzle longitudinal axis, with $xPF \geq 2\Delta r1$.

10. The nozzle according to claim 1, wherein, at a radially inner third surface of the fuel guiding channel, a concave curvature is provided via which an upstream obliquely radially inward oriented section of the third surface transitions into a section of the third surface that extends axially at the end of the fuel guiding channel.

11. The nozzle according to claim 10, wherein the concave curvature of the third surface has a radius of maximally 15 mm.

12. The nozzle according to claim 1, wherein a sharp-edged transition is formed at the end of the fuel guiding channel between a fourth channel surface of the first air guiding channel and a radially inner third channel surface of the fuel guiding channel, and/or that a sharp-edged transition is formed at the end of the tapering channel portion between the first channel surface and an inner channel surface of the second air guiding channel.

13. An engine with the nozzle according to claim 1.

14. The nozzle according to claim 12, wherein the curvature has a radius of maximally 2 mm.

15. A nozzle for a combustion chamber of an engine for providing a fuel-air mixture at a nozzle exit opening of the nozzle, the nozzle comprising:

a nozzle main body that comprises the nozzle exit opening and that extends along a nozzle longitudinal axis, the nozzle main body further comprising:

a first air guiding channel for conveying air to the nozzle exit opening, the first air guiding channel also extending along the nozzle longitudinal axis, a fuel guiding channel for conveying fuel to the nozzle exit opening that is positioned radially further outwardly as compared to the first air guiding channel with respect to the nozzle longitudinal axis, and a second air guiding channel that is positioned radially further outwardly as compared to the fuel guiding channel with respect to the nozzle longitudinal axis, wherein an end of the fuel guiding channel at which fuel from the fuel guiding channel flows out in a direction of the air from the first air guiding channel, is positioned—with respect to the nozzle longitudinal axis and in a direction of the nozzle exit opening—in front of an end of the second air guiding channel from which air from the second air guiding channel flows out in a direction of a mixture of air from the first air guiding channel and fuel from the fuel guiding channel, a tapering channel portion with a first channel surface inclined with respect to the nozzle longitudinal axis in an axial direction and connecting to a radially outer second channel surface of the fuel guiding channel, the tapering channel portion positioned between the end of the fuel guiding channel and the end of the second air guiding channel;

wherein, in an area of the end of the fuel guiding channel, the first channel surface is offset radially outwards by a distance ($\Delta r1$) to an end of a fourth channel surface of the first air guiding channel, and the tapering channel portion extends with a length (xPF) along the nozzle longitudinal axis, with $xPF \geq 2\Delta r1$.

16. A nozzle for a combustion chamber of an engine for providing a fuel-air mixture at a nozzle exit opening of the nozzle, the nozzle comprising:

a nozzle main body that comprises the nozzle exit opening and that extends along a nozzle longitudinal axis, the nozzle main body further comprising:

a first air guiding channel for conveying air to the nozzle exit opening, the first air guiding channel also extending along the nozzle longitudinal axis, a fuel guiding channel for conveying fuel to the nozzle exit opening that is positioned radially further outwardly as compared to the first air guiding channel with respect to the nozzle longitudinal axis, and a second air guiding channel that is positioned radially further outwardly as compared to the fuel guiding channel with respect to the nozzle longitudinal axis, wherein an end of the fuel guiding channel at which fuel from the fuel guiding channel flows out in a direction of the air from the first air guiding channel, is positioned—with respect to the nozzle longitudinal axis and in a direction of the nozzle exit opening—in front of an end of the second air guiding channel from which air from the second air guiding channel flows out in a direction of a mixture of air from the first air guiding channel and fuel from the fuel guiding channel, a tapering channel portion with a first channel surface inclined with respect to the nozzle longitudinal axis in an axial direction and connecting to a radially outer second channel surface of the fuel guiding channel, the tapering channel portion positioned between the end of the fuel guiding channel and the end of the second air guiding channel, the tapering channel portion ending at the end of the second air guiding channel;

wherein, at a radially inner third surface of the fuel guiding channel, a concave curvature is provided via which an upstream obliquely radially inward oriented section of the third surface transitions into a section of the third surface that extends axially at the end of the fuel guiding channel;

wherein the concave curvature of the third surface has a radius of maximally 15 mm.

* * * * *